US009126327B1

(12) United States Patent
Goodrich, Jr.

(10) Patent No.: US 9,126,327 B1
(45) Date of Patent: Sep. 8, 2015

(54) PIPE JOINT SCRIBE KIT

(71) Applicant: Harry R. Goodrich, Jr., Burlington, WA (US)

(72) Inventor: Harry R. Goodrich, Jr., Burlington, WA (US)

( * ) Notice: Subject to any disclaimer, the term of this patent is extended or adjusted under 35 U.S.C. 154(b) by 171 days.

(21) Appl. No.: 13/920,325

(22) Filed: Jun. 18, 2013

(51) Int. Cl.
*B43L 7/027* (2006.01)
*B43L 7/033* (2006.01)
*B25H 7/00* (2006.01)

(52) U.S. Cl.
CPC ..... *B25H 7/005* (2013.01)

(58) Field of Classification Search
CPC ..... B23D 21/10; B25H 7/005; B25H 7/006; B25H 7/007; B43L 7/027; B43L 7/003
USPC ..... 33/21.3, 474, 475, 482, 529
See application file for complete search history.

(56) References Cited

U.S. PATENT DOCUMENTS

| | | | | |
|---|---|---|---|---|
| 1,610,193 | A | 12/1926 | Battle | |
| 1,778,981 | A | 10/1930 | McLaughlin | |
| 2,334,422 | A | 11/1943 | Lehnus | |
| 2,835,981 | A * | 5/1958 | Kaufman | 33/529 |
| 3,623,232 | A * | 11/1971 | Mahlstadt | 33/474 |
| 4,375,724 | A * | 3/1983 | Brock | 33/529 |
| 2008/0148587 | A1 * | 6/2008 | Goodrich | 33/529 |
| 2013/0111772 | A1 * | 5/2013 | Vadala | 33/480 |

* cited by examiner

*Primary Examiner* — G. Bradley Bennett
(74) *Attorney, Agent, or Firm* — Crossley Patent Law

(57) ABSTRACT

A pipe joint scribe kit for welding pipes together at intersections, which may or may not be perpendicular, including a plurality of single-piece scriber bodies, each body having a pair of parallelepiped arms, with incremental graduations marked thereon, disposed at a fixed angle with respect to each other with at least one angle portion disposed between the arms.

7 Claims, 5 Drawing Sheets

PIPE JOINT SCRIBE KIT

BACKGROUND OF THE INVENTION

Various types of pipe scribers are known in the prior art. These previous pipe scribers are often limited in the type of connection that can be scribed, perhaps only a "T" branch connection for example. In addition, many of the previous pipe scribers require multiple adjustments prior to use. Some of the previous pipe scribers are formed of multiple elements, including coil springs and gears, that can break. The present device addresses the foregoing issues by providing a pipe joint scribe kit for welding pipes together at intersections, which may or may not be perpendicular, the kit providing a plurality of single-piece scriber bodies, each body having a pair of parallelepiped arms, with incremental graduations marked thereon, disposed at a fixed angle with respect to each other with at least one angle portion disposed between the arms.

FIELD OF THE INVENTION

The present invention relates to pipe scribers, and more particularly, to a pipe joint scribe kit which provides a plurality of single-piece scriber bodies, each body having a pair of parallelepiped arms, with incremental graduations marked thereon, disposed at a fixed angle with respect to each other with at least one angle portion disposed between the arms.

SUMMARY OF THE INVENTION

The general purpose of the present pipe joint scribe kit, described subsequently in greater detail, is to provide a pipe joint scribe kit which has many novel features that result in a pipe joint scribe kit which is not anticipated, rendered obvious, suggested, or even implied by prior art, either alone or in combination thereof.

To accomplish this, the present pipe joint scribe kit, designed for welding a pair of pipes together at intersections, which may or may not be perpendicular is illustrated. The instant pipe joint scribe kit includes a single-piece arcuate first scriber body for welding pipes together at a 90-degree angle and a single-piece arcuate second scriber body for welding pipes together at a 45-degree angle. Each of the first and second scriber bodies has a parallelepiped first arm, a parallelepiped second arm, and a first angle portion disposed therebetween.

Each of the first and second arms has an inside edge and an outside edge. A concave interior edge of the first angle portion is continuously disposed between the inside edge of the first arm and the inside edge of the second arm. A convex exterior edge of the first angle portion is continuously disposed between the outside edge of the first arm and the outside edge of the second arm in a position opposite the interior edge.

The first angle portion of the first scriber body has a greater angle than the first angle portion of the second scriber body. The first arm and the second arm of the first scriber body are perpendicular to each other. The first arm and the second arm of the second scriber body are positioned at a 45-degree angle relative to each other. The first arm has a length at least twice as long as a length of the second arm in each of the first scriber body and the second scriber body. A plurality of incremental graduations is disposed on each of the inside and outside edges of the first and second arms.

The kit also provides a single-piece arcuate third scriber body for welding a pair of pipes in a gooseneck fitting together. The third scriber body has a parallelepiped first member, a parallelepiped second member, a first angle section disposed proximal the second member, and a second angle section. The second angle section is continuously disposed between the first angle section and the first member. Each of the first and second members has an inner edge and an outer edge. The first and second angle sections are continuously disposed between the first and second members. The second angle section has an internal edge and a straight external edge.

A U-shaped interior side of the first angle section is disposed between the inner edge of the second member and the internal edge of the second angle section. A convex exterior side of the first angle section is disposed between the outer edge of the second member and the external edge of the second angle section in a position opposite the interior side. The external edge of the second angle section is perpendicular to the outer edge of the second member. The configuration of the first angle section accommodates a gooseneck pipe fitting.

A plurality of incremental graduations is disposed on each of the inner and outer edges of the first and second members. In the third scriber body, the second member has a length at least three-fourths a length of the first member.

Thus has been broadly outlined the more important features of the present pipe joint scribe kit so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
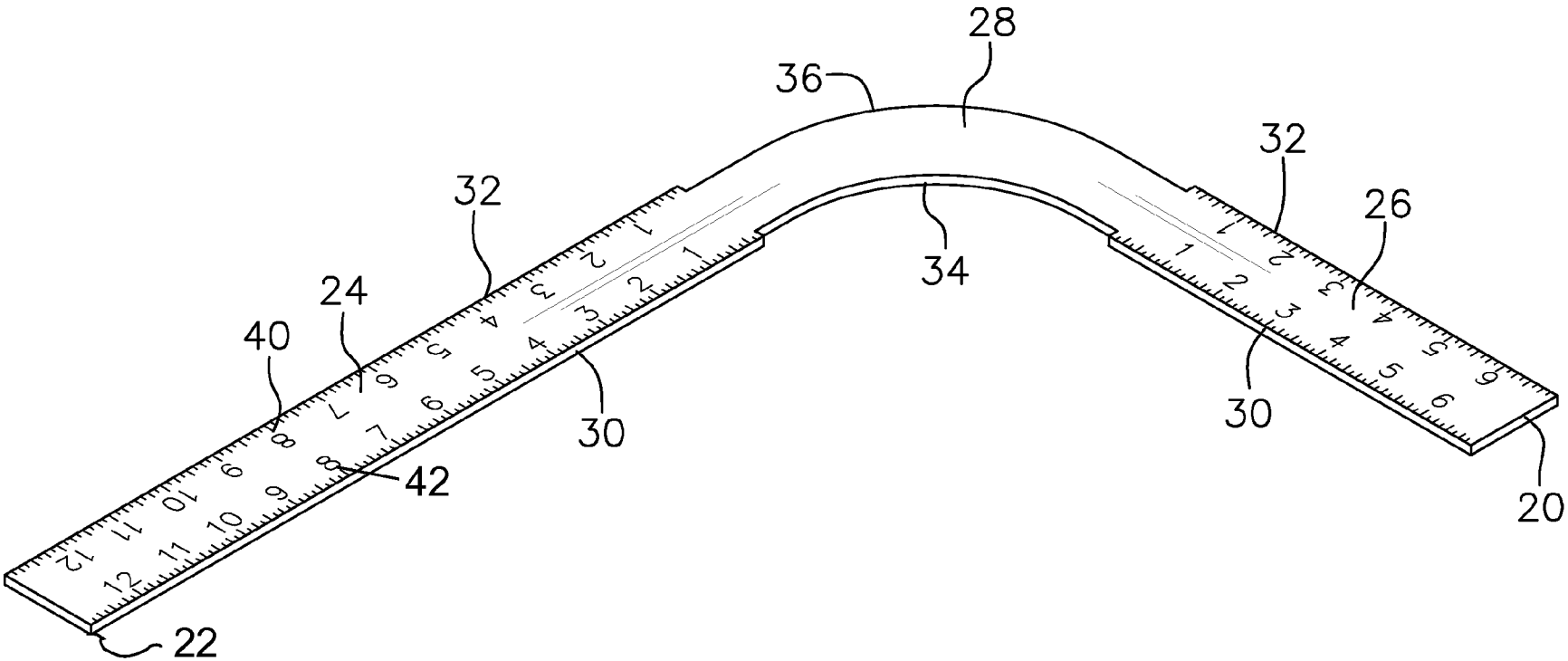
FIG. 1 is an isometric view of a 90-degree scriber body.
Figure 2:
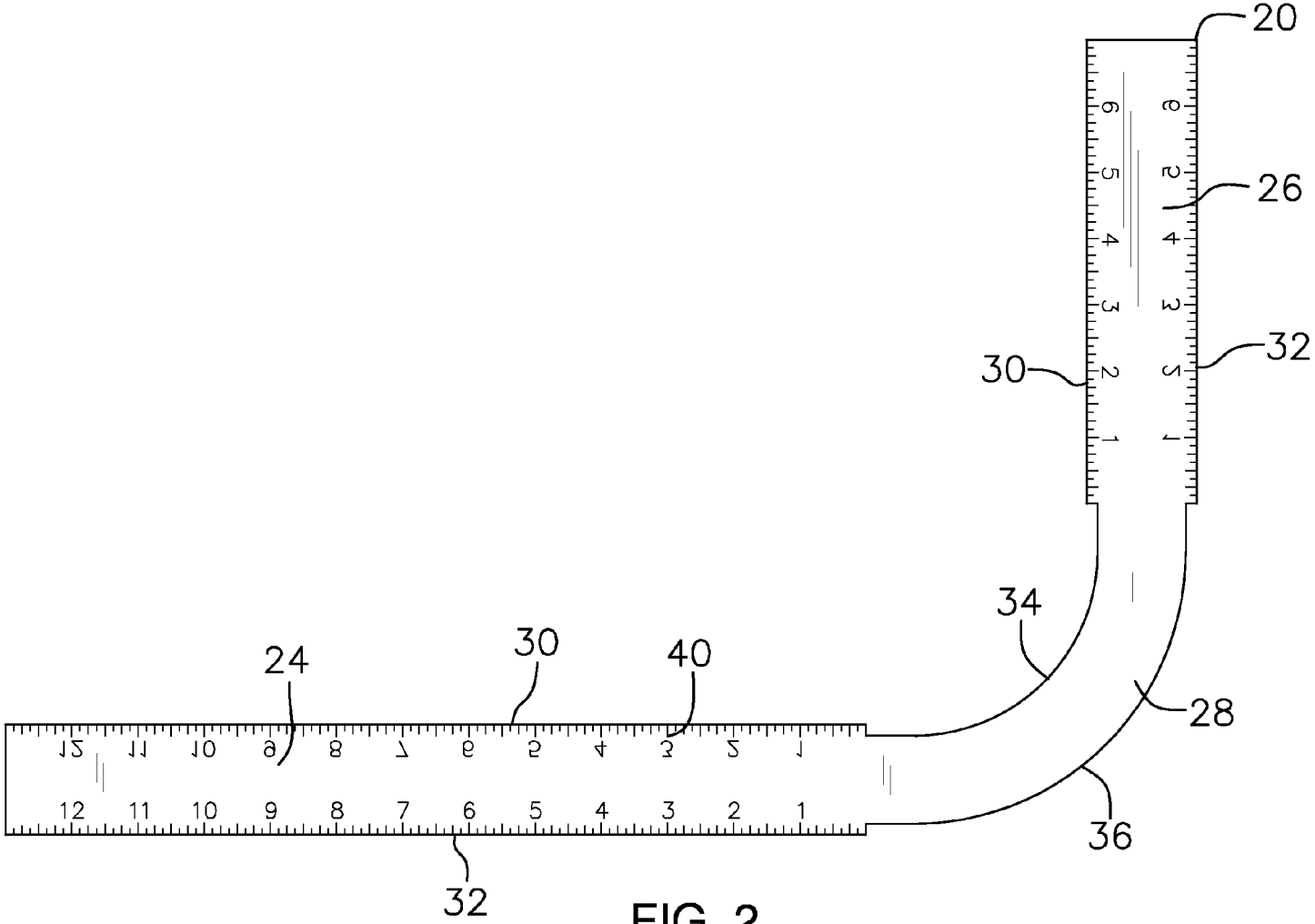
FIG. 2 is a top plan view thereof.
Figure 3:
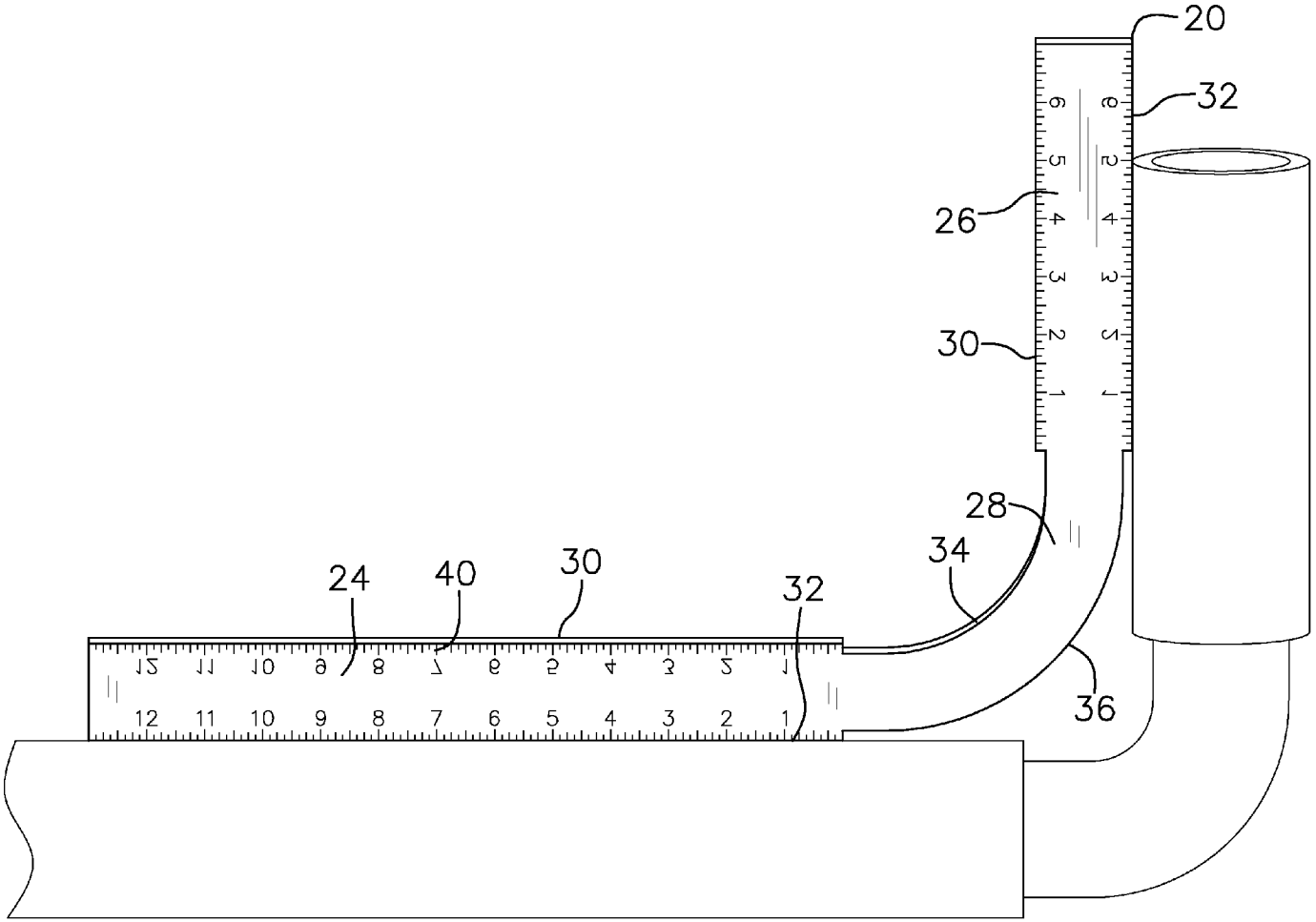
FIG. 3 is an in-use top plan view thereof.
Figure 4:
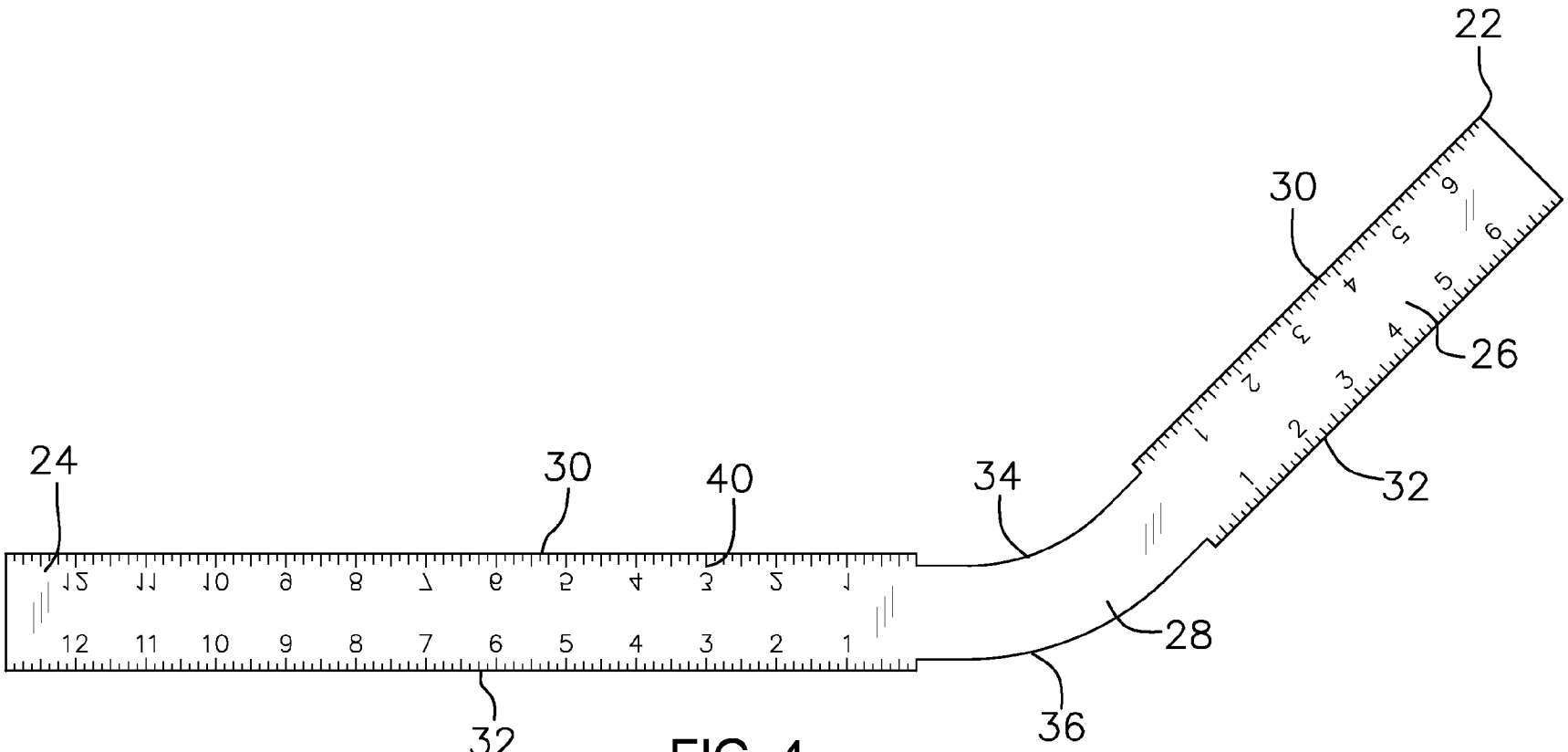
FIG. 4 is a top plan view of a 45-degree scriber body.
Figure 5:
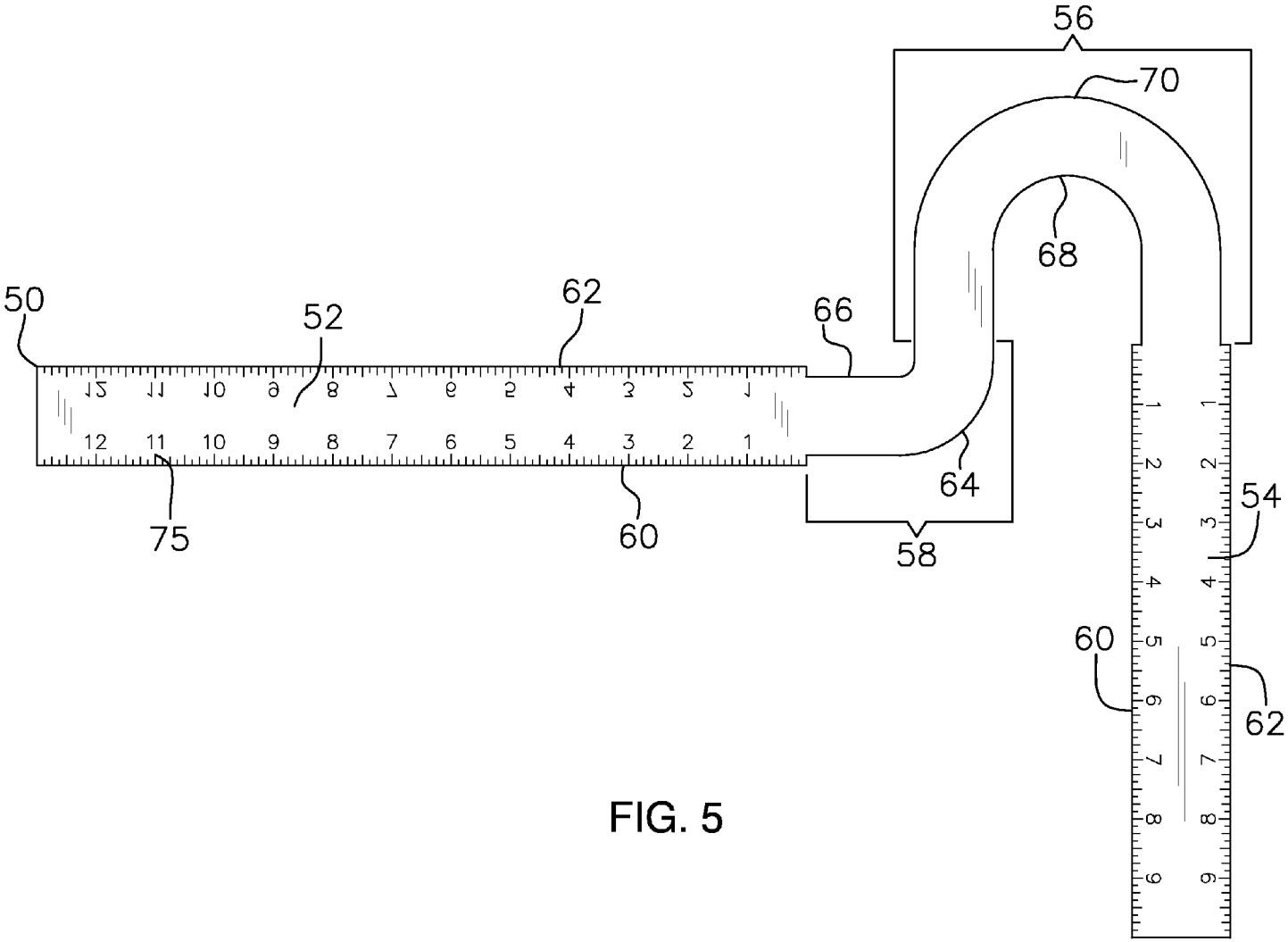
FIG. 5 is a top plan view of a gooseneck scriber body.

With reference now to the drawings, and in particular FIGS. 1 through 5 thereof, an example of the instant pipe joint scribe kit employing the principles and concepts of the present pipe joint scribe kit will be described.

Referring to FIGS. 1 through 5, the present pipe joint scribe kit for welding pipes together at intersections which may or may not be perpendicular is illustrated. The instant pipe joint scribe kit includes a single-piece arcuate first scriber body 20 for welding pipes together at a 90-degree angle and a single-piece arcuate second scriber body 22 for welding pipes together at a 45-degree angle. Each of the first and second scriber bodies 20, 22 has a parallelepiped first arm 24, a parallelepiped second arm 26, and a first angle portion 28 disposed therebetween.

Each of the first and second arms 24, 26 has an inside edge 30 and an outside edge 32. A concave interior edge 34 of the first angle portion 28 is continuously disposed between the inside edge 30 of the first arm 24 and the inside edge 30 of the second arm 26. A convex exterior edge 36 of the first angle portion 28 is continuously disposed between the outside edge 32 of the first arm 24 and the outside edge 32 of the second arm 26 in a position opposite the interior edge 34.

The first angle portion 28 of the first scriber body 20 has a greater angle than the first angle portion 28 of the second scriber body 20. The first arm 24 and the second arm 26 of the first scriber body 20 are perpendicular to each other. The first arm 24 and the second arm 26 of the second scriber body 22 are positioned at a 45-degree angle relative to each other. The first arm 24 has a length at least twice as long as a length of the second arm 26 in each of the first scriber body 20 and the second scriber body 22. A plurality of incremental graduations 40 is disposed on each of the inside and outside edges 30, 32 of the first and second arms 24, 26. A plurality of indicia 42 corresponding to the incremental graduations 40 is provided. The plurality of indicia 42 on the inside edge 30 of each of the first and second arms 24, 26 is in a mirror image arrangement relative the plurality of indicia 42 on the outside edge 32 of each of the first and second arms 24, 26.

The kit also provides a single-piece arcuate third scriber body 50 for welding a pair of pipes including a gooseneck fitting together. The third scriber body 50 has a parallelepiped first member 52, a parallelepiped second member 54, a first angle section 56 disposed proximal the second member 54, and a second angle section 58. The second angle section 58 is continuously disposed between the first angle section 56 and the first member 52. Each of the first and second members 52, 54 has an inner edge 60 and an outer edge 62. The first and second angle sections 56, 58 are continuously disposed between the first and second members 52, 54. The second angle section 58 has an internal edge 64 and a straight external edge 66.

A U-shaped interior side 68 of the first angle section 56 is disposed between the inner edge 60 of the second member 54 and the internal edge 64 of the second angle section 58. A convex exterior side 70 of the first angle section 56 is disposed between the outer edge 62 of the second member 54 and the external edge 66 of the second angle section 64 in a position opposite the interior side 68. The external edge 66 of the second angle section 58 is perpendicular to the outer edge 62 of the second member 54. A plurality of incremental graduations 75 is disposed on each of the inner and outer edges 60, 62 of the first and second members 52, 54. In the third scriber body, the second member 54 has a length at least three-fourths a length of the first member 52.

What is claimed is:

1. A pipe joint scribe kit comprising:

a single-piece arcuate first scriber body;

a single-piece arcuate second scriber body conjoined to the first scriber body;

wherein each of the first and second scriber bodies comprises:

a parallelepiped first arm, a parallelepiped second arm, and a first angle portion disposed therebetween, each of the first and second arms having an inside edge and an outside edge;

a concave interior edge of the first angle portion continuously disposed between the inside edge of the first arm and the inside edge of the second arm;

a convex exterior edge of the first angle portion continuously disposed between the outside edge of the first arm and the outside edge of the second arm in a position opposite the interior edge, the first angle portion of the first scriber body having a greater angle than the first angle portion of the second scriber body;

a plurality of incremental graduations on each of the inside and outside edges of the first and second arm; and a plurality of indicia corresponding to the incremental graduations, wherein the plurality of indicia on the inside edge of each of the first and second arms is in a mirror image arrangement relative the plurality of indicia on the outside edge of each of the first and second arms.

2. The pipe joint scribe kit of claim 1 wherein the first arm and the second arm of the first scriber body are perpendicular to each other.

3. The pipe joint scribe kit of claim 1 wherein the first arm and the second arm of the second scriber body are positioned at a 45-degree angle relative to each other.

4. A pipe joint scribe kit comprising:

a single-piece arcuate first scriber body;

a single-piece arcuate second scriber body conjoined to the first scriber body;

wherein each of the first and second scriber bodies comprises:

a parallelepiped first arm, a parallelepiped second arm, and a first angle portion disposed therebetween, each of the first and second arms having an inside edge and an outside edge;

a concave interior edge of the first angle portion continuously disposed between the inside edge of the first arm and the inside edge of the second arm;

a convex exterior edge of the first angle portion continuously disposed between the outside edge of the first arm and the outside edge of the second arm in a position opposite the interior edge, the first angle portion of the first scriber body having a greater angle than the first angle portion of the second scriber body; and a plurality of incremental graduations on each of the inside and outside edges of the first and second arm;

a single-piece arcuate third scriber body having a parallelepiped first member, a parallelepiped second member perpendicular to the second member, a first angle section disposed proximal the second member, and a second angle section continuously disposed between the first angle section and the first member, each of the first and second members having an inner edge and an outer edge, the first and second angle sections are continuously disposed between the first and second members, the second angle section having an internal edge and a straight external edge;

a U-shaped interior side of the first angle section disposed between the inner edge of the second member and the internal edge of the second angle section;

a convex exterior side of the first angle section disposed between the outside edge of the second member and the external edge of the second angle section in a position opposite the interior side, the external edge of the second angle section being perpendicular to the outer edge of the second member; and a plurality of incremental graduations on each of the inner and outer edges of the first and second members.

5. The pipe joint scribe of claim 2 wherein the first arm has a length at least twice as long as a length of the second arm.

6. The pipe joint scribe of claim 3 wherein the first arm has a length at least twice as long as a length of the second arm.

7. The pipe joint scribe of claim 4 wherein the second member has a length at least three-fourths a length of the first member.

* * * * *